US006352417B1

(12) United States Patent
Zamudio et al.

(10) Patent No.: US 6,352,417 B1
(45) Date of Patent: Mar. 5, 2002

(54) OPTIMIZED RADIAL COMPLIANCE FOR A SCROLL COMPRESSOR

(75) Inventors: Carlos Zamudio, Arkadelphia, AR (US); Joe T. Hill, Bristol, VA (US); Gregory W. Hahn, Arkadelphia, AR (US); Zili Sun, Arkadelphia, AR (US); Jason Hugenroth, Hope, AR (US); Thomas Barito, Arkadelphia, AR (US); John R. Williams, Bristol, VA (US); James W. Bush, Skaneateles, NY (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/707,434

(22) Filed: Nov. 6, 2000

(51) Int. Cl.[7] ..... F04C 18/00
(52) U.S. Cl. ..... 418/55.5; 418/57; 418/14
(58) Field of Search ..... 418/55.5, 57, 14

(56) References Cited

U.S. PATENT DOCUMENTS 5,328,342 A * 7/1994 Ishii et al. ..... 418/55.5
5,496,157 A * 3/1996 Shoulders et al. ..... 418/55.5
5,520,524 A * 5/1996 Takemoto et al. ..... 418/14

FOREIGN PATENT DOCUMENTS

JP 5-187366 A * 7/1993 ..... 418/55.5
JP 6-185476 A * 7/1994 ..... 418/55.5
JP 6-185477 A * 7/1994 ..... 418/55.5

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A scroll compressor is provided with structure between its slider block and its eccentric pin that allows relative movement, but limits such movement. In one embodiment, a spring biased piston resists relative movement between the slider block and the eccentric pin. In another embodiment, incrementally spaced indexed surfaces are defined. With either embodiment the amount of relative movement of the slider block is limited relative to the eccentric pin and hence between the wraps of the orbiting scrolls. This will result in quieter operation.

12 Claims, 2 Drawing Sheets

OPTIMIZED RADIAL COMPLIANCE FOR A SCROLL COMPRESSOR

BACKGROUND OF THE INVENTION

This invention relates to a scroll compressor wherein the main benefits of fixed throw and radially compliant compressors are both achieved.

Scroll compressors are becoming widely utilized in refrigerant compression applications. In a scroll compressor, a first scroll member has a base and a generally spiral wrap extending from the base. The second scroll member has a base and a generally spiral wrap extending from its base. The wraps of the two scroll members interfit to define compression chambers. The shaft is driven by an electric motor to rotate, and causes the orbiting scroll to orbit relative to the non-orbiting scroll. As the two orbit relative to each other, the size of the compression chambers decrease, and an entrapped refrigerant is compressed. The compression chambers are partially defined by contact between the flanks of the wraps of the two scroll members. In one type of scroll compressor, the position of the two wraps relative to each other is relatively fixed through the orbit. Such a scroll compressor is known as a "fixed throw".

While a fixed throw compressor does have some benefits, it also has downsides. In particular, fixed throw scroll compressors are usually quieter than a second type of scroll compressor known as "radially compliant". However, tolerance control in a fixed throw scroll may result in significant leakage gaps between the scroll flanks. Moreover, if there is ever an entrapped contaminant, a fixed throw scroll member does not have all of the benefits of a radially compliant scroll.

In a radially compliant scroll, the connection between the driveshaft and the orbiting scroll is a through a slider block such that the orbiting scroll can move or "slide" into and away from engagement from the non-orbiting scroll wrap. A centrifugal force forces the scroll wraps into contact. A force between the two wraps will tend to move the scroll members out of the contact at their flank surfaces. Due to the centrifugal force acting between the two, there is thus a significant amount of sliding contact. Hence, the operational noise of a radially compliant scroll is greater than that of a fixed throw scroll.

SUMMARY OF THE INVENTION

In a disclosed embodiment of this invention, the scroll compressor has a radially compliant orbiting scroll wrap connected to the driveshaft through a slider block. However, structure is also incorporated into the connection to limit or dampen movement of the orbiting scroll relative to the non-orbiting scroll. It can also limit or eliminate the centrifugal force acting between the two scroll wraps. In a first embodiment, a damper piston extends from an eccentric drive pin on the shaft into contact with the inner bore of the slider block. The piston will resist the force from the centrifugal force tending to move the orbiting scroll into contact with the non-orbiting scroll. Thus, the damper piston, which is spring biased outwardly of the eccentric pin, acts in conjunction with a flank contact force to resist the centrifugal force. In this way, flank contact force is minimized. However, the goal of maintaining the scroll wrap flanks in close proximity to each other is achieved. The spring force should be designed to achieve a maximum orbit, with minimal flank contact during most of that orbit.

In a second embodiment, a normally flat drive surface between the eccentric pin and the inner bore of the slider block has a number of incremental positioning structures. As an example, saw-tooth shapes can be formed on the two surfaces. The relative position of the slider block and the eccentric pin indexes along the incremental surfaces such that a large contact force between the flanks will cause movement of the slider block relative to the pin through the positioning structures to allow the orbiting scroll to move away from the non-orbiting scroll. On the other hand, the incremental positioning surfaces also allow the position of the slider block to advance along the eccentric pin until a balanced position is reached for the particular scroll arrangement. In a sense, the structure will then approximate a fixed throw scroll compressor that is ideally designed for the particular manufacturing tolerances of the components in that scroll compressor.

In general, the application could be described as a scroll compressor having a relationship between a slider block and an eccentric pin wherein the two are structured to allow movement of the slider block relative to the pin, but to limit such movement during operation.

These and other features of the present invention can be best understood from the following specification and drawings. The following of which is a brief description.

DETAILED DESCRIPTION OF A PREFERRED EMBODIMENT

Figure 1:
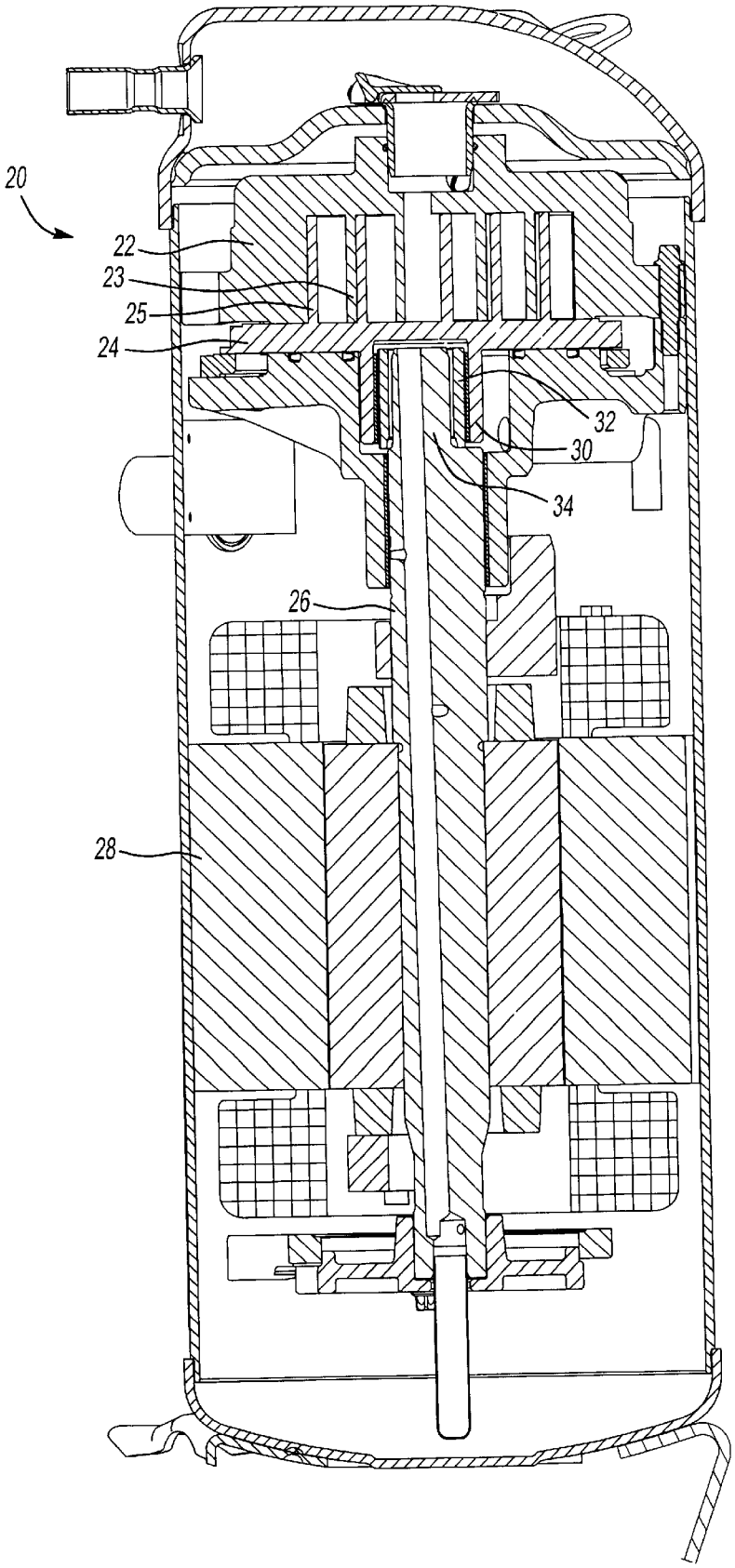
FIG. 1 is a cross-sectional view through a first embodiment scroll compressor.

FIG. 1 shows a scroll compressor 20 incorporating a non-orbiting scroll 22 having a wrap 23. The orbiting scroll 24 has its wrap 25 interfitting with the wrap 23, as known.

A driveshaft 26 is driven by an electric motor 28. The orbiting scroll 24 has downwardly extending boss 30 which receives a slider block 32. The slider block 32 surrounds the eccentric pin 34.

Figure 2:
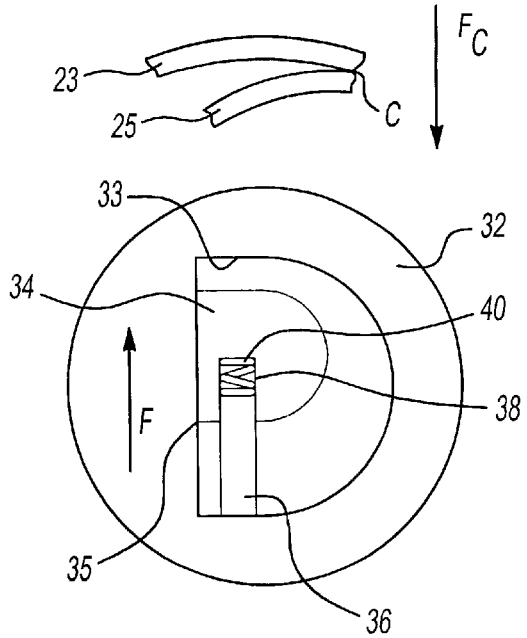
FIG. 2 shows the first embodiment compressor.

As shown in FIG. 2, the slider block 32 has a bore 33 which receives the eccentric pin 34. The two have sliding surfaces shown in engagement at 35 to permit movement between the eccentric pin 34 and the slider block 32, as is known. The present invention is directed to a damper piston 36 which is forced outwardly of a bore 38 in the pin 34 by a spring 40. During forward rotation a centrifugal force F is applied to the slider block 32 tending to move it upwardly as shown in FIG. 2, in the direction of the arrow F. With this movement, the wrap 25 is brought into contact with the wrap 23 at its flanks, as shown schematically at point C near the top of FIG. 2.

With this contact, an opposing contact force $F_c$ is created. The force $F_c$ acts between the sliding surfaces of wraps 25 and 23 and vibration from the sliding friction and from interference between imperfections in the two surfaces results. This vibration is transferred through the compressor structure and results in some unwanted noise. The vibration also results in the orbiting scroll 24 moving vertically as shown in FIG. 2, with the sliding surfaces of the slider block 32 and eccentric pin 34 accommodating the movement. The piston 36 tends to dampen or slow down the rate of that movement by providing a force that tends to resist movement. Since the downward motion of orbiting scroll 24 is driven by mechanical interactions, its movement is not appreciably slowed by piston 36. However, since its upward movement (as shown in FIG. 2) is driven only by centrifugal forces, its upward movement is slowed by the resisting force of piston 36 and for a time contact between the sliding surfaces of wraps 25 and 23 is reduced or eliminated. For a time, the force $F_c$ is supplemented or replaced by the resisting force of piston 36 until the wraps 25 and 23 eventually come back into contact. At that time the next excursion downward (as shown in FIG. 2) of the orbiting scroll 24 restarts the cycle and the force $F_c$ is again reduced or eliminated.

In addition to this, the force from spring 40 tends to also reduce $F_c$, but its influence diminishes as the wraps 25 and 23 separate and the orbiting scroll moves downwards as shown in FIG. 2. Thus, the spring provides its greatest effect when the wraps 25 and 23 are near or in contact, which is where it is most needed to reduce $F_c$. When the wraps 25 and 23 are greatly separated, which would induce undesired leakage, the influence of spring 40 is reduced and it does not resist the upward movement of the orbiting scroll 24 needed to re-establish the close clearance or contact between wraps 25 and 23 needed to assure sealing and low leakage.

Figure 3:
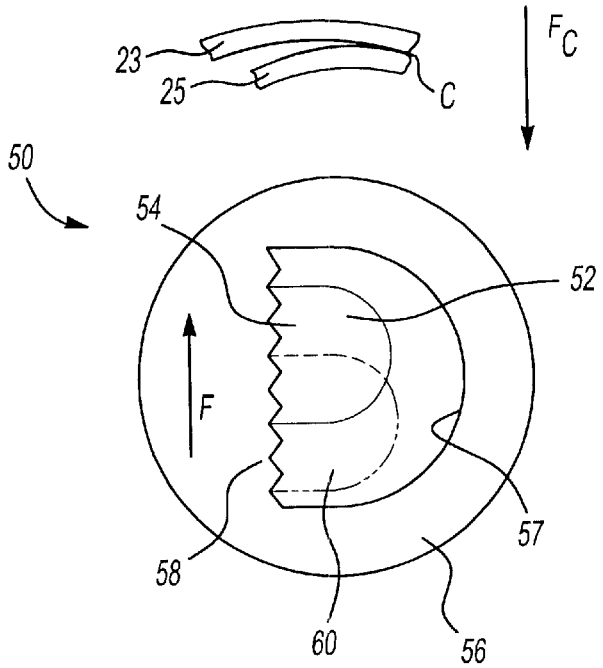
FIG. 3 shows a second embodiment.

FIG. 3 shows another embodiment 50 wherein the eccentric pin 52 is provided with a plurality of saw-tooth shaped irregular surface portions 54. The slider block 56 has its bore 57 formed with a plurality of mating surfaces 58. Although saw-tooth shaped portions are shown, any other incremental indexed surface structures can be utilized. As shown, the force F will be applied to the slider block during rotation as in the prior embodiment. The force $F_c$ will also be applied as the scroll wraps 23 and 25 are brought into contact. The force $F_c$ increases as the force F brings the wrap 25 into undue engagement with the wrap 23, or if a contaminant is trapped between the two. The incremental surface structures 54 and 58 will find a equilibrium position such that the amount of movement of the slider block 56 relative to the pin 52 will be limited. Only movement sufficient to cause a force to exceed an inertia or holding frictional force between the structures 54 and 58 will cause any movement of the slider block 56 relative to the pin 52, and hence allow movement between the wraps 23 and 25. Thus, in effect, this embodiment will approximate the drive arrangement of a fixed throw scroll compressor while still allowing movement of the wraps 23 and 25 should there be a contaminant captured between the two. Moreover, by utilizing the incremental index structure an optimum can be achieved between the wraps 23 and 25 for the particular manufacturing tolerances in the particular scroll compressor components.

The preferred embodiments of this invention have been disclosed, however, a worker in this art would recognize that many modifications would come within the scope of this invention. For that reasons the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, said second scroll member having an extending boss defining an inner bore;

a driveshaft extending toward said scroll member, said drive shaft having an eccentric pin positioned eccentric relative to a drive axis of said shaft, said eccentric pin fitting within a slider block, said slider block being positioned within said bore of said boss of said second scroll member such that said eccentric pin drives said slider block and hence said second scroll member to orbit relative to said first scroll member; and a centrifugal force on said slider block causing said slider block to move in a first direction relative to said eccentric pin, and there being structure between said eccentric pin and said slider block for resisting such movement.

2. A scroll compressor as recited in claim 1, wherein a spring dampens relative movement between said slider block and said eccentric pin.

3. A scroll compressor as recited in claim 2, wherein a piston is spring biased to resist movement of said slider block relative to said eccentric pin.

4. A scroll compressor as recited in claim 3, wherein said spring and said piston are received within a bore in said eccentric pin.

5. A scroll compressor as recited in claim 1, wherein a piston dampens relative movement between said slider block and said eccentric pin.

6. A scroll compressor as recited in claim 1, wherein a plurality of incremental index positions are defined between said eccentric pin and said slider block, said incremental index positions allow a plurality of incrementally spaced relative positions between said slider block and said eccentric pin.

7. A scroll compressor as recited in claim 6, wherein said incremental index positions include a plurality of surface structures on an inner face surface between a bore in said slider block and said eccentric pin.

8. A scroll compressor as recited in claim 7, wherein said incremental indexed structures are generally saw-tooth shaped.

9. A scroll compressor comprising:

a first scroll member having a base and a generally spiral wrap extending from said base;

a second scroll member having a base and a generally spiral wrap extending from its base, said second scroll member having an extending boss defining an inner bore;

a driveshaft extending toward said second scroll, said drive shaft having an eccentric pin positioned eccentric relative to a drive axis of said shaft, said eccentric pin fitting within a slider block, said slider block being positioned within said bore of said boss of said second scroll member such that said eccentric pin drives said slider block and hence said second scroll member to orbit relative to said first scroll member; and a centrifugal force on said slider block causing said slider block to move in a first direction relative to said eccentric pin, and there being structure for resisting such movement, said structure for resisting movement including a spring biased piston positioned between said eccentric pin and said slider block to resist such movement.

10. A scroll compressor comprising:

a first scroll member having a base and a generally spiral wrap extending from said base;

a second scroll member having a base and a generally spiral wrap extending from its base, said second scroll member having an extending boss defining an inner bore;

a driveshaft extending toward said second scroll, said drive shaft having an eccentric pin positioned eccentric relative to a drive axis of said shaft, said eccentric pin fitting within a slider block, said slider block being positioned within said bore of said boss of said second scroll member such that said eccentric pin drives said slider block and hence said second scroll member to orbit relative to said first scroll member; and a centrifugal force on said slider block causing said slider block to move in a first direction relative to said eccentric pin, and there being structure for resisting such movement, said structure including a plurality of incremental index structures to provide a plurality of incrementally spaced relative positions between said eccentric pin and said slider block.

11. A scroll compressor as recited in claim 10, wherein said incremental index positions include a plurality of surface structures on an inner face surface between a bore in said slider block and said eccentric pin.

12. A scroll compressor as recited in claim 11, wherein said incremental indexed structures are generally saw-tooth shaped.

* * * * *